US005966963A

United States Patent [19]

Kovalaske

[11] Patent Number: 5,966,963

[45] Date of Patent: Oct. 19, 1999

[54] REFRIGERATOR WITH A THIRD DOOR

[76] Inventor: Kenneth A. Kovalaske, N11293 Highway A, Fox Lake, Wis. 53933

[21] Appl. No.: 09/126,339

[22] Filed: Jul. 30, 1998

[51] Int. Cl.[6] ..... F25D 11/02

[52] U.S. Cl. ..... 62/441; 62/440; 312/405

[58] Field of Search ..... 62/440, 441; 312/292, 312/404, 405, 405.1

[56] References Cited

U.S. PATENT DOCUMENTS

| | | | |
|---|---|---|---|
| 2,656,688 | 10/1953 | Hinkel | 62/99 |
| 4,586,347 | 5/1986 | McCarty | 62/265 |
| 5,209,082 | 5/1993 | Ha | 62/265 |
| 5,702,168 | 12/1997 | Shin | 312/405 |
| 5,737,939 | 4/1998 | Valence | 62/441 |

*Primary Examiner*—Henry Bennett
*Assistant Examiner*—Melvin Jones

[57] ABSTRACT

A new refrigerator with a third door for reducing loss of the cold air held in a refrigeration compartment of a refrigerator by permitting access to a top shelf of the refrigeration compartment without opening the entire door covering the refrigeration compartment. The inventive device includes a refrigerator that has a refrigeration compartment, a freezer compartment, a fridge opening into the refrigeration compartment, and a freezer opening into the freezer compartment. A first door covers the fridge opening into the refrigeration compartment of the refrigerator and is pivotally coupled to the first side of the refrigerator. A second door covers the freezer opening into the freezer compartment of the refrigerator and is pivotally coupled to the first side of the refrigerator. The first door has an aperture that extends through it from a primary end of the first door towards a secondary end of the first door. A third door is provided in the aperture of the first door. A first end of the third door is pivotally coupled to the first side of the refrigerator and is positionable between a closed position and an opened position when the first door is closed.

13 Claims, 3 Drawing Sheets

REFRIGERATOR WITH A THIRD DOOR

BACKGROUND OF THE INVENTION

1. Field of the Invention

The present invention relates to refrigerators and more particularly pertains to a new refrigerator with a third door for reducing loss of the cold air held in a refrigeration compartment of a refrigerator by permitting access to a top shelf of the refrigeration compartment without opening the entire door covering the refrigeration compartment.

2. Description of the Prior Art

The use of refrigerators is known in the prior art. More specifically, refrigerators heretofore devised and utilized are known to consist basically of familiar, expected and obvious structural configurations, notwithstanding the myriad of designs encompassed by the crowded prior art which have been developed for the fulfillment of countless objectives and requirements.

Known prior art refrigerators include U.S. Pat. No. 5,209,082; U.S. Pat. No. 4,586,347; U.S. Pat. No. 4,368,622; U.S. Pat. No. 5,100,213; U.S. Pat. No. 2,890,573; and U.S. Pat. No. Des. 244,684.

While these devices fulfill their respective, particular objectives and requirements, the aforementioned patents do not disclose a new refrigerator with a third door. The inventive device includes a refrigerator that has a refrigeration compartment, a freezer compartment, a fridge opening into the refrigeration compartment, and a freezer opening into the freezer compartment. A first door covers the fridge opening into the refrigeration compartment of the refrigerator and is pivotally coupled to the first side of the refrigerator. A second door covers the freezer opening into the freezer compartment of the refrigerator and is pivotally coupled to the first side of the refrigerator. The first door has an aperture that extends through it from a primary end of the first door towards a secondary end of the first door. A third door is provided in the aperture of the first door. A first end of the third door is pivotally coupled to the first side of the refrigerator and is positionable between a closed position and an opened position when the first door is closed.

In these respects, the refrigerator with a third door according to the present invention substantially departs from the conventional concepts and designs of the prior art, and in so doing provides an apparatus primarily developed for the purpose of reducing loss of the cold air held in a refrigeration compartment of a refrigerator by permitting access to a top shelf of the refrigeration compartment without opening the entire door covering the refrigeration compartment.

SUMMARY OF THE INVENTION

In view of the foregoing disadvantages inherent in the known types of refrigerators now present in the prior art, the present invention provides a new refrigerator with a third door construction wherein the same can be utilized for reducing loss of the cold air held in a refrigeration compartment of a refrigerator by permitting access to a top shelf of the refrigeration compartment without opening the entire door covering the refrigeration compartment.

The general purpose of the present invention, which will be described subsequently in greater detail, is to provide a new refrigerator with a third door apparatus and method which has many of the advantages of the refrigerators mentioned heretofore and many novel features that result in a new refrigerator with a third door which is not anticipated, rendered obvious, suggested, or even implied by any of the prior art refrigerators, either alone or in any combination thereof.

To attain this, the present invention generally comprises a refrigerator that has a refrigeration compartment, a freezer compartment, a fridge opening into the refrigeration compartment, and a freezer opening into the freezer compartment. A first door covers the fridge opening into the refrigeration compartment of the refrigerator and is pivotally coupled to the first side of the refrigerator. A second door covers the freezer opening into the freezer compartment of the refrigerator and is pivotally coupled to the first side of the refrigerator. The first door has an aperture that extends through it from a primary end of the first door towards a secondary end of the first door. A third door is provided in the aperture of the first door. A first end of the third door is pivotally coupled to the first side of the refrigerator and is positionable between a closed position and an opened position when the first door is closed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refrigerator with a third door apparatus and method which has many of the advantages of the refrigerators mentioned heretofore and many novel features that result in a new refrigerator with a third door which is not anticipated, rendered obvious, suggested, or even implied by any of the prior art refrigerators, either alone or in any combination thereof.

It is another object of the present invention to provide a new refrigerator with a third door which may be easily and efficiently manufactured and marketed.

It is a further object of the present invention to provide a new refrigerator with a third door which is of a durable and reliable construction.

An even further object of the present invention is to provide a new refrigerator with a third door which is susceptible of a low cost of manufacture with regard to both materials and labor, and which accordingly is then susceptible of low prices of sale to the consuming public, thereby making such refrigerator with a third door economically available to the buying public.

Still yet another object of the present invention is to provide a new refrigerator with a third door which provides in the apparatuses and methods of the prior art some of the advantages thereof, while simultaneously overcoming some of the disadvantages normally associated therewith.

Still another object of the present invention is to provide a new refrigerator with a third door for reducing loss of the cold air held in a refrigeration compartment of a refrigerator by permitting access to a top shelf of the refrigeration compartment without opening the entire door covering the refrigeration compartment.

Yet another object of the present invention is to provide a new refrigerator with a third door which includes a refrigerator that has a refrigeration compartment, a freezer compartment, a fridge opening into the refrigeration compartment, and a freezer opening into the freezer compartment. A first door covers the fridge opening into the refrigeration compartment of the refrigerator and is pivotally coupled to the first side of the refrigerator. A second door covers the freezer opening into the freezer compartment of the refrigerator and is pivotally coupled to the first side of the refrigerator. The first door has an aperture that extends through it from a primary end of the first door towards a secondary end of the first door. A third door is provided in the aperture of the first door. A first end of the third door is pivotally coupled to the first side of the refrigerator and is positionable between a closed position and an opened position when the first door is closed.

Still yet another object of the present invention is to provide a new refrigerator with a third door that saves energy by permitting access to only a portion of the refrigeration compartment of a refrigerator without having to open the door covering the entire refrigeration compartment, thereby releasing much of the cold air held in the refrigeration compartment.

Even still another object of the present invention is to provide a new refrigerator with a third door that permits easier access to the contents held on the top shelf of a refrigerator for handicapped persons because they may be able to open the third door without having to move out of the way to open the door covering the entire refrigeration compartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
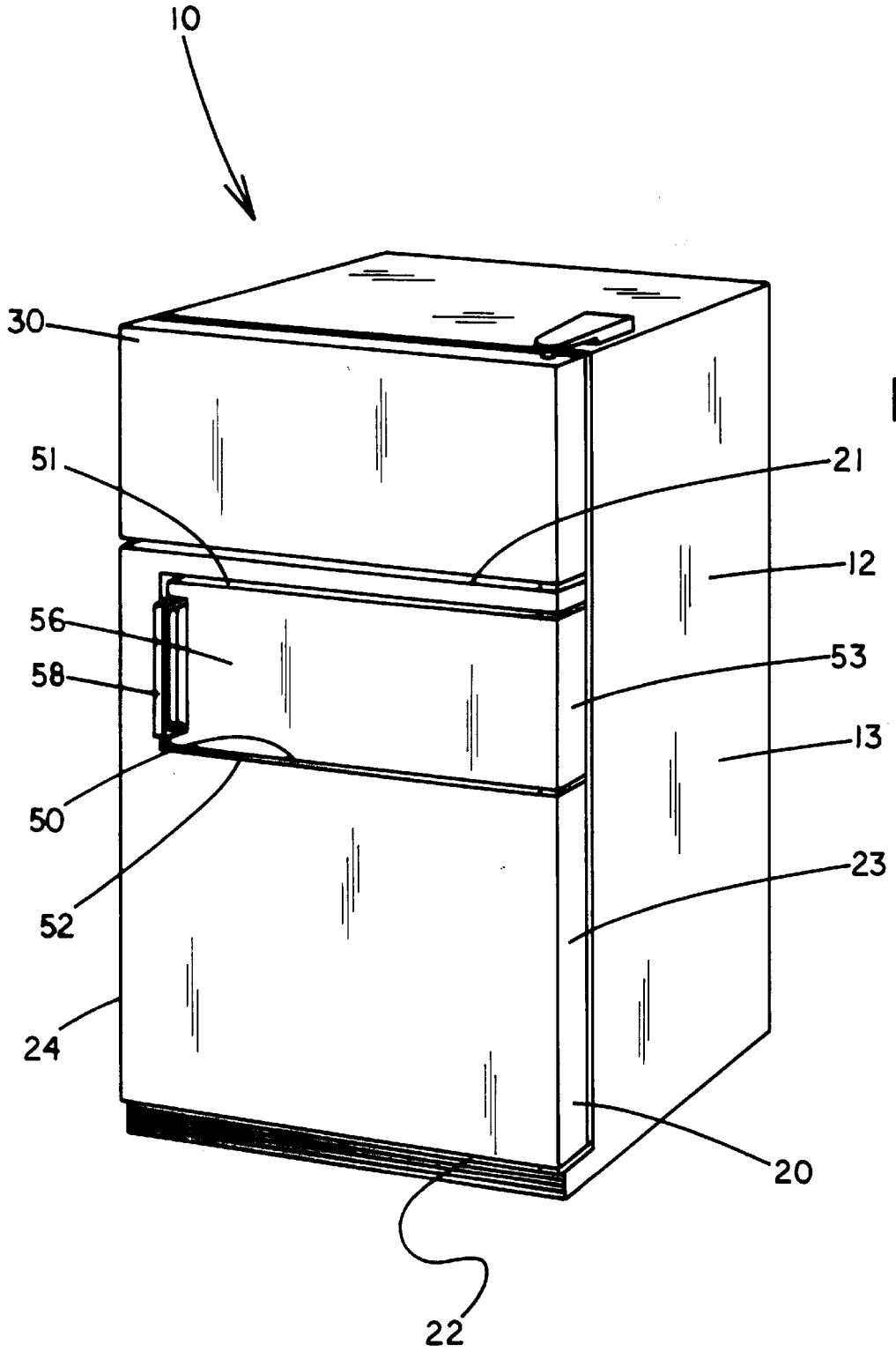
FIG. 1 is a schematic perspective view of a new refrigerator with a third door according to the present invention.
Figure 2:
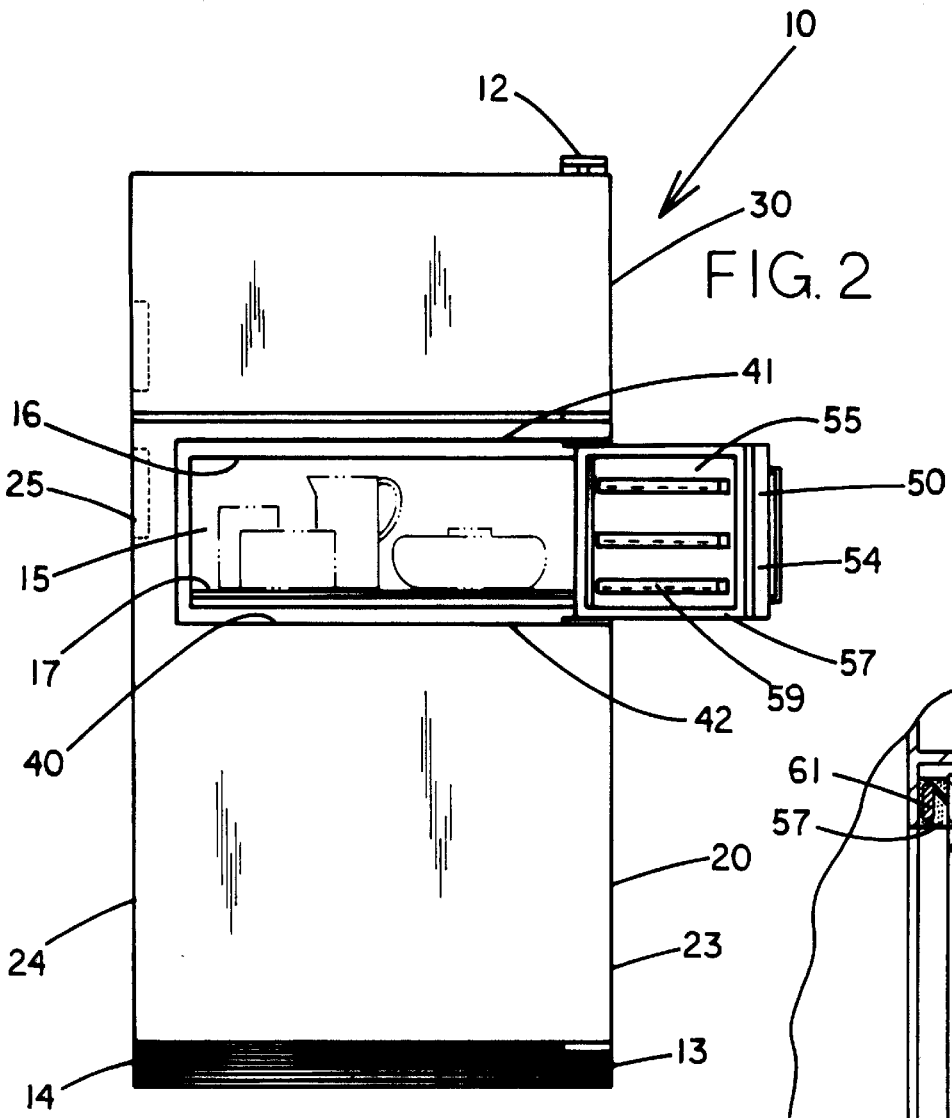
FIG. 2 is a schematic side view of the present invention.
Figure 3:
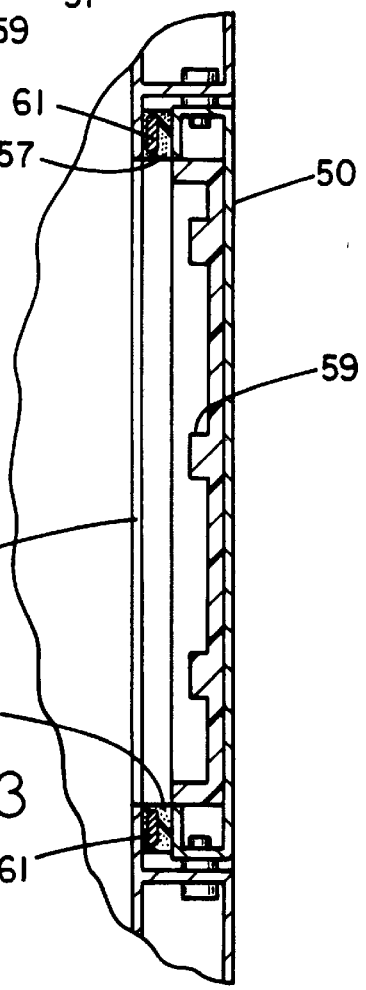
FIG. 3 is a schematic cross-sectional view of the present invention.
Figure 4:
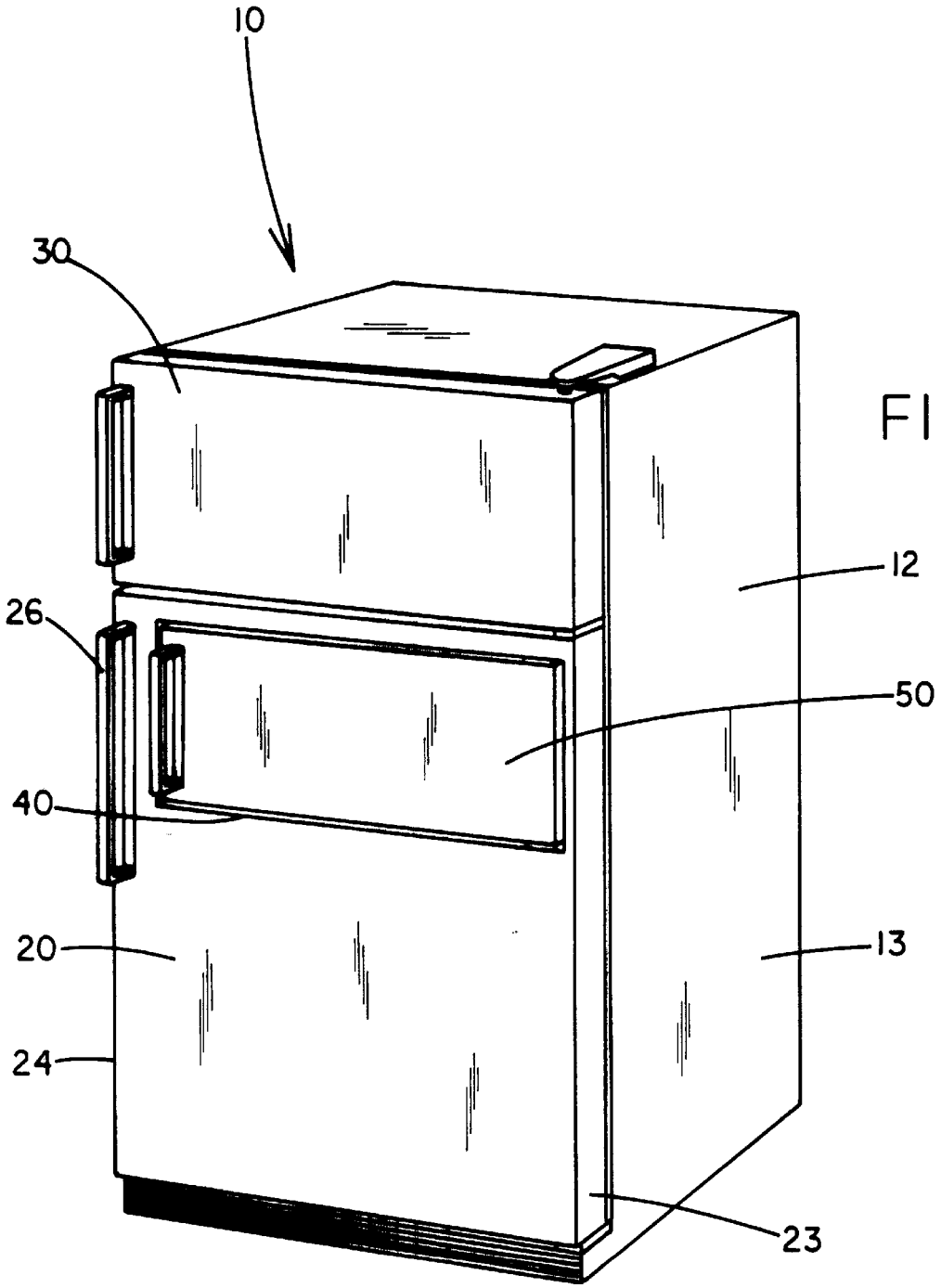
FIG. 4 is a schematic perspective view of an alternate embodiment of the present invention.

With reference now to the drawings, and in particular to FIGS. 1 through 4 thereof, a new refrigerator with a third door embodying the principles and concepts of the present invention and generally designated by the reference numeral 10 will be described.

As best illustrated in FIGS. 1 through 4, the refrigerator with a third door 10 comprises a refrigerator 12 that has a refrigeration compartment 15, a freezer compartment (not shown) positioned either above or below the refrigeration compartment 15, a fridge opening 16 into the refrigeration compartment 15, and a freezer opening (not shown) into the freezer compartment (not shown). A first door 20 covers the fridge opening 16 into the refrigeration compartment 15 of the refrigerator 12 and is pivotally coupled to the first side 13 of the refrigerator 12.

A second door 30 covers the freezer opening (not shown) into the freezer compartment (not shown) of the refrigerator 12 and is pivotally coupled to the first side 13 of the refrigerator 12. The first door 20 has an aperture 40 that extends through it from a primary end 23 of the first door 20 towards a secondary end 24 of the first door 20.

A third door 50 is provided in the aperture 40 of the first door 20. A first end 53 of the third door 50 is pivotally coupled to the first side 13 of the refrigerator 12 and is positionable between a closed position and an opened position when the first door 20 is closed. The third door 50 covers the aperture 40 of the first door 20 when the third door 50 is in the closed position. The second end 54 of the third door 50 is spaced apart from the primary end 23 of the first door 20 when the third door 50 is in the opened position.

The refrigerator 12 has first and second sides 13, 14. The freezer compartment (not shown) may be positioned either above or below the refrigeration compartment 15. Preferably, the refrigeration compartment 15 has a plurality of shelves disposed therein.

The first door 20 has a top end 21, a bottom end 22, and primary and secondary ends 23, 24 that extend between the top and bottom ends 21, 22 of the first door 20. The primary end 23 of the first door 20 is pivotally coupled to the first side 13 of the refrigerator 12. Preferably, the secondary end 24 of the first door 20 has a handle slot 25 that extends from the secondary end 24 of the first door 20 towards the primary end 23 of the first door 20. The use of a handle slot 25 positioned in the secondary end 24 of the first door 20 is preferable to use of a protruding handle 58 because the handle slot 25 will not interfere with access to the handle 58 of the third door 50. However, in an alternate embodiment, a handle 26 may be positioned on an outer surface of the first door 20 between the aperture 40 of the first door 20 and the secondary end 24 of the first door 20. In a variation of this alternate embodiment, a handle (not shown) may be positioned on the outer surface of the first door 20 towards the secondary end 24 of the first door 20 and below the aperture 40.

The first door 20 is positionable between an open position and a shut position. The first door 20 covers the fridge opening 16 into the refrigeration compartment 15 of the refrigerator 12 when the first door 20 is in the open position. The secondary end 24 of the first door 20 is spaced apart from the second side 14 of the refrigerator 12 when the first door 20 is in the shut position.

The aperture 40 extends through the first door 20 from the primary end 23 of the first door 20 towards the secondary end 24 of the first door 20. Preferably, the aperture 40 of the first door 20 is positioned towards the top end 21 of the first door 20. Ideally, the aperture 40 extends from the primary end 23 of the first door 20 to a position slightly below an uppermost shelf in the refrigeration compartment 15 of the refrigerator 12.

Preferably, the aperture 40 of the first door 20 is generally rectangular and has a periphery that has an upper edge 41 and a lower edge 42. A vertical length of the aperture 40 is defined between the upper and lower edges 41, 42 of the aperture 40. Also, a vertical length of the first door 20 is defined between the top and bottom ends 21, 22 of the first door 20. In the preferred embodiment, the vertical length of the aperture 40 is between about one-fourth to one-third the vertical length of the first door 20. For example, the ideal vertical length of the aperture 40 is fifteen inches for a refrigerator 12 sixty inches tall with a thirty nine inch tall first door 20. This provides greater access to the top shelf 17 in the refrigerator 12 compartment while permitting visual identification of the objects resting on the shelf immediately below the top shelf 17.

Also preferably, the distance between the top end 21 of the first door 20 and the aperture 40 of the first door 20 is less than about two inches to provide the largest access to the top shelf 17 in the refrigerator 12 compartment while providing greater strength and stability of the first door 20. Ideally, the distance between the top end 21 of the first door 20 and the aperture 40 of the first door 20 is about one inch.

Preferably, the distance between the secondary end 24 of the first door 20 and the aperture 40 of the first door 20 is less than about two and one-half inches to provide the largest access to the top shelf 17 in the refrigerator 12 compartment while providing greater strength and stability of the first door 20.

The third door 50 is provided in the aperture 40 of the first door 20 and has an upper end 51, a lower end 52, first and second end 54*s* that extend between the upper and lower ends 51, 52, and inner and outer surface 55, 56. The first end 53 of the third door 50 is pivotally coupled to the first side 13 of the refrigerator 12. The third door 50 is positionable between a closed position and an opened position. The third door 50 covers the aperture 40 of the first door 20 when the third door 50 is in the closed position. The second end 54 of the third door 50 is spaced apart from the primary end 23 of the first door 20 when the third door 50 is in the opened position. Preferably, the third door 50 is generally rectangular.

In an alternate embodiment, the aperture 40 of the first door 20 extends from a position towards the primary end 23 of the first door 20 towards the secondary end 24 of the first door 20. In such an embodiment, the third door 50 is coupled to the primary end 23 of the first door 20.

Ideally, the first end 53 of the third door 50 and the primary end 23 of the first door 20 lie on the same plane. Also ideally, the distance between the upper and lower edges 41,42 of the third door 50 is between about one-fourth to one-third the vertical length of the first door 20. Most ideally, the distance between the upper and lower edges 41, 42 of the third door 50 is fourteen inches but may vary with the size of the refrigerator 12. For example, the ideal distance between the upper and lower edges 41, 42 of the third door 50 is fourteen inches for a sixty inch tall refrigerator 12 that has a thirty nine inch tall first door 20. Also ideally, the outer surface 56 of the third door 50 lies on the same plane as the outer surface of the first door 20.

Preferably, the upper and lower ends 51,52 and the first and second ends 53, 54 of the third door 50 define an outer periphery of the third door 50. The inner surface 55 of the third door 50 has a seal 57 that extends therearound along the outer periphery of the third door 50. The seal 57 may be made of rubber or any other suitable material.

Also preferably, the outer surface 56 of the third door 50 has a handle 58 mounted to it. Ideally, the handle 58 is positioned towards the second end 54 of the third door 50.

Preferably, the inner surface 55 of the third door 50 has a plurality of rails 59 mounted to it. The rails 59 permit mounting of a rack (not shown) or bin (not shown), or multiple racks or bins thereon. Ideally, the inner surface 55 of the third door 50 has three rails 59 mounted to it.

Preferably, the third door 50 travels with the first door 20 when the first door 20 moves between the first position and the second position, but the third door 50 is positionable between a closed position and an opened position when the first door 20 is closed. To attain this, the first door 20 has a first catch (not shown) thereon. The first catch (not shown) holds the first door 20 closed when the third door 50 moves from the closed position towards the opened position. The third door 50 has a second catch (not shown) such that the third door 50 is movable from the closed position towards the opened position without opening the first door 20. In the preferred embodiment, the first door 20 has a pair of magnetic catches or strips. The third door 50 has a magnetic strip 61 that is disposed in the seal 57 of the third door 50.

Preferably, the refrigeration compartment 15 of the refrigerator 12 has an interior light (not shown) in it. A switch (not shown) is electrically coupled to the interior light (not shown) in the refrigeration compartment 15 of the refrigerator 12. The switch (not shown) permits passage of power to the interior light (not shown) when the third door 50 is in an opened position.

In use, objects are placed on the shelves in the refrigeration compartment 15. Also, bins or racks may be mounted on the rails 59 on the inner surface 55 of the third door 50. When access to an object located on the top shelf 17 in the refrigeration compartment 15 is desired, the third door 50 is pulled towards an opened position. The first door 20 stays in a shut position to help hold a majority of the cold air in the refrigeration compartment 15 while objects are accessed from the top shelf 17 and the bins or racks on the third door 50. A visual review of the objects resting on the shelf immediately below the top shelf 17 is also possible.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refrigerator, comprising:

a refrigerator having first and second sides, a refrigeration compartment, a freezer compartment, a fridge opening into said refrigeration compartment, and a freezer opening into said freezer compartment;

a first door covering said fridge opening into said refrigeration compartment of said refrigerator;

said first door having a top end, a bottom end, and primary and secondary ends extending between said top and bottom ends, said primary end of said first door being pivotally coupled to said first side of said refrigerator, a second door covering said freezer opening into said freezer compartment of said refrigerator and being pivotally coupled to said first side of said refrigerator;

said first door having an aperture extending therethrough from said primary end towards said secondary end of said first door;

wherein the distance between said top end of said first door and said aperture of said first door is less than two inches for enhancing access to said top shelf in said refrigerator compartment through said aperture;

a third door being provided in said aperture of said first door, said third door having an upper end, a lower end, first and second ends extending between said upper and lower ends, and inner and outer surfaces, said first end of said third door being pivotally coupled to said first side of said refrigerator; and said third door being positionable between a closed position and an opened position when said first door is closed, said third door covering said aperture of said first door when said third door is in said closed position, said second end of said third door being spaced apart from said primary end of said first door when said third door is in said opened position.

2. The refrigerator of claim 1, wherein said first door has a first catch thereon, said first catch holding said first door closed when said third door moves from said closed position towards said opened position.

3. The refrigerator of claim 1, wherein said third door has a second catch thereon such that said third door is movable from said closed position towards said opened position without opening said first door.

4. The refrigerator of claim 1, wherein said secondary end of said first door has a handle slot extending from said secondary end towards said primary end of said first door, said outer surface of said third door having a handle mounted thereon, said handle being positioned towards said second end of said third door.

5. The refrigerator of claim 1, wherein said inner surface of said third door having a plurality of rails being mounted thereon.

6. The refrigerator of claim 5, wherein said inner surface of said third door has three rails being mounted thereon.

7. The refrigerator of claim 1, wherein said aperture of said first door is positioned towards said top end of said first door.

8. The refrigerator of claim 1, wherein said aperture of said first door is generally rectangular, said aperture having a periphery having an upper edge and a lower edge, wherein a vertical length of said aperture is defined between said upper and lower edges of said aperture, wherein a vertical length of said first door is defined between said top and bottom ends of said first door, wherein said vertical length of said aperture is between about one-fourth to one-third said vertical length of said first door.

9. The refrigerator of claim 1, wherein the distance between said secondary end of said first door and said aperture of said first door is less than two and one-half inches for enhancing access to said top shelf in said refrigerator compartment through said aperture.

10. The refrigerator of claim 1, wherein said upper and lower ends and said first and second ends of said third door define an outer periphery of said third door, said inner surface of said third door having a seal extending therearound along said outer periphery of said third door.

11. The refrigerator of claim 1, further comprising a switch, said refrigeration compartment of said refrigerator has an interior light therein, said switch being electrically coupled to said interior light in said refrigeration compartment of said refrigerator, said switch permitting passage of power to said interior light when said third door is in an opened position.

12. A refrigerator, comprising:

a refrigerator having first and second sides, a refrigeration compartment, a freezer compartment, a fridge opening into said refrigeration compartment, and a freezer opening into said freezer compartment;

said refrigeration compartment having a plurality of shelves being disposed therein;

a first door covering said fridge opening into said refrigeration compartment of said refrigerator;

said first door having a top end, a bottom end, and primary and secondary ends extending between said top and bottom ends, said primary end of said first door being pivotally coupled to said first side of said refrigerator, said secondary end of said first door having a handle slot extending from said secondary end towards said primary end of said first door;

a second door covering said freezer opening into said freezer compartment of said refrigerator and being pivotally coupled to said first side of said refrigerator;

said first door having an aperture extending therethrough from said primary end towards said secondary end of said first door, said aperture being generally rectangular;

said aperture of said first door being positioned towards said top end of said first door;

said aperture of said first door having a periphery having an upper edge and a lower edge, wherein a vertical length of said aperture is defined between said upper and lower edges of said aperture;

wherein a vertical length of said first door is defined between said top and bottom ends of said first door;

wherein said vertical length of said aperture is between one-fourth to one-third said vertical length of said first door;

wherein the distance between said top end of said first door and said aperture of said first door is less than two inches for enhancing access to said top shelf in said refrigerator compartment through said aperture;

wherein the distance between said secondary end of said first door and said aperture of said first door is less than two and one-half inches for enhancing access to said top shelf in said refrigerator compartment through said aperture;

a third door being generally rectangular and being provided in said aperture of said first door, said third door having an upper end, a lower end, first and second ends extending between said upper and lower ends, and inner and outer surfaces, said first end of said third door being pivotally coupled to said first side of said refrigerator;

said third door being positionable between a closed position and an opened position, said third door covering said aperture of said first door when said third door is in said closed position, said second end of said third door being spaced apart from said primary end of said first door when said third door is in said opened position;

wherein said upper and lower ends and said first and second ends of said third door define an outer periphery of said third door, said inner surface of said third door having a seal extending therearound along said outer periphery of said third door;

said outer surface of said third door having a handle mounted thereon, said handle being positioned towards said second end of said third door;

said inner surface of said third door having a plurality of rails being mounted thereon;

wherein said inner surface of said third door has three rails being mounted thereon;

wherein said third door is positionable between a closed position and an opened position when said first door is closed;

said first door having a first catch thereon, said first catch holding said first door closed when said third door moves from said closed position towards said opened position;

said third door having a second catch thereon such that said third door is movable from said closed position towards said opened position without opening said first door;

said refrigeration compartment of said refrigerator having an interior light therein; and a switch being electrically coupled to said interior light in said refrigeration compartment of said refrigerator, said switch permitting passage of power to said interior light when said third door is in an opened position.

13. A refrigerator, comprising:

a refrigerator having first and second sides, a refrigeration compartment, a freezer compartment, a fridge opening into said refrigeration compartment, and a freezer opening into said freezer compartment;

a first door covering said fridge opening into said refrigeration compartment of said refrigerator;

said first door having a top end, a bottom end, and primary and secondary ends extending between said top and bottom ends, said primary end of said first door being pivotally coupled to said first side of said refrigerator, a second door covering said freezer opening into said freezer compartment of said refrigerator and being pivotally coupled to said first side of said refrigerator;

said first door having an aperture extending therethrough from said primary end towards said secondary end of said first door;

a third door being provided in said aperture of said first door, said third door having an upper end, a lower end, first and second ends extending between said upper and lower ends, and inner and outer surfaces, said first end of said third door being pivotally coupled to said first side of said refrigerator;

said third door being positionable between a closed position and an opened position when said first door is closed, said third door covering said aperture of said first door when said third door is in said closed position, said second end of said third door being spaced apart from said primary end of said first door when said third door is in said opened position; and said third door being pivotable about the same axis as said first door.

* * * * *